United States Patent [19]

Fuhrhop et al.

[11] Patent Number: 4,795,138

[45] Date of Patent: Jan. 3, 1989

[54] METALLURGICAL TUYERE AND METHOD OF CALIBRATING SAME

[75] Inventors: Ronald E. Fuhrhop, Belle Mead; Allan R. Wandelt, Warren, both of N.J.

[73] Assignee: L-TEC Company, Florence, S.C.

[21] Appl. No.: 121,931

[22] Filed: Nov. 18, 1987

[51] Int. Cl.[4] ..... C21C 5/48

[52] U.S. Cl. ..... 266/44; 266/266; 266/268

[58] Field of Search ..... 266/44, 47, 218, 266, 266/268, 287

[56] References Cited

U.S. PATENT DOCUMENTS

| | | | |
|---|---|---|---|
| 3,397,878 | 8/1968 | Holmes et al. | 266/268 |
| 3,781,002 | 12/1973 | Courard | 266/268 |
| 3,917,243 | 11/1975 | Borgnat et al. | 266/267 |
| 4,022,447 | 5/1977 | Griffiths | 266/266 |
| 4,023,676 | 5/1977 | Bennett et al. | 266/222 |
| 4,040,612 | 8/1977 | Leroy et al. | 266/268 |
| 4,171,798 | 10/1979 | Vietorisz | 266/47 |
| 4,239,532 | 12/1980 | Allersma et al. | 266/268 |
| 4,249,719 | 2/1981 | Knuppel et al. | 266/47 |
| 4,268,017 | 5/1981 | Cole | 266/265 |
| 4,340,209 | 7/1982 | Abascal | 266/266 |
| 4,385,753 | 5/1983 | Leroy et al. | 266/268 |
| 4,417,723 | 11/1983 | Kitamura et al. | 266/265 |
| 4,434,976 | 3/1984 | Murakami et al. | 266/268 |
| 4,449,701 | 5/1984 | Pitzer et al. | 266/218 |
| 4,494,736 | 1/1985 | Guttmann | 266/265 |

FOREIGN PATENT DOCUMENTS

| | | | |
|---|---|---|---|
| 2387291 | 12/1978 | France | 266/266 |
| 1024505 | 6/1983 | U.S.S.R. | 266/266 |

OTHER PUBLICATIONS

"Theory of AOD Steel Foundry Applications", AFS Transactions, 79-115, pp. 565-568.

*Primary Examiner*—L. Dewayne Rutledge
*Assistant Examiner*—Robert L. McDowell
*Attorney, Agent, or Firm*—Bell, Seltzer, Park & Gibson

[57] ABSTRACT

A tuyere is disclosed which is adapted for the injection of gases into a metallurgical vessel. The tuyere includes inner and outer concentric tubes having a radial separation therebetween which defines an annular gap. In use, one gas such as an oxygen mixture flows through the center of the inner tube, and a second normally inert gas flows through the annular gap between the two tubes. In order to provide a closely predetermined and predictable gas flow rate through the annular gap, annular groove is formed in the wall of the outer tube which forms an annular restriction in the gap, and the extent of the restriction may be calibrated so as to provide a closely predetermined gas flow rate therethrough when in use. An annular groove may also be formed in the wall of the inner tube to provide a predetermined restriction in the gas flowing through the inner tube. The restrictions are positioned adjacent the respective inlet ends of the tubes, so that erosion of the outlet ends does not appreciably effect the gas flow rates through the inner tube and annular gap. A calibration process is also disclosed, and which assures that all of the tuyeres to be used in a common metallurgical vessel have a closely similar gas flow rate through the annular gap.

17 Claims, 2 Drawing Sheets

METALLURGICAL TUYERE AND METHOD OF CALIBRATING SAME

BACKGROUND OF THE INVENTION

The present invention relates to a tuyere of the type adapted for the injection of gases into a metallurgical vessel and which is characterized by a closely predetermined gas flow rate therethrough when in use.

The use of tuyeres in metallurgical vessels, such as a metal refining furnace or a molten metal container, for submerged blowing steel-making processes, is well known. For example, in the conventional argon oxygen decarburization (AOD) process for making stainless steel, a number of tuyeres are inserted into an AOD vessel. Each such tuyere comprises inner and outer concentric tubes, and such that one gas may be injected through the inner tube, and an auxiliary or shroud gas may be simultaneously injected through the annular gap formed between the tubes. Normally, oxygen or an oxygen mixture flows through the inner tube, and argon or other inert gas, flows in the annular gap formed between the concentric tubes. Depending on the vessel size, there can be one to seven tuyeres, or even more, in each AOD vessel.

As is known, control of the gas flow and the uniform distribution thereof into the vessel are extremely important, not only for enhancing the efficiency of the steel-making process, but also to reduce non-uniform erosion of the vessel walls and the tuyeres themselves. An uneven distribution between tuyeres within the vessel results in non-uniform erosion of the vessel lining and the discharge ends of the tuyeres, and it increases the likelihood of the need for premature replacement of the vessel lining.

The gas control system for the tuyeres in the above described conventional AOD process typically has one flow or pressure controller feeding a common manifold to which the several tuyeres are connected. The piping and manifold system can be designed to produce equal distribution of gas to each tuyere, but each tuyere is the final restriction in the piping system, and the flow characteristics in the tuyeres must be equal in order to obtain equal flow through each tuyere, when connected to a common manifold. Using the present tuyeres of the concentric double tube type, it is very difficult to achieve a predictable gas flow characteristic in the annular gap, in view of the difficulty in achieving manufacturing uniformity. More particularly, the center tube is normally made of copper, and the outer tube is normally made of stainless steel. Once assembled, the outer tube must be precisely concentric with the inner tube to provide a uniform flow characteristic in the annular gap. In present tuyeres, this concentric relationship is maintained by depressions or dimples which are formed in the outer tube and so that the dimples extend inwardly to contact the inner tube and to thereby guide and support the outer tube in a concentric arrangement with the inner tube. As will be apparent, the manufacturing tolerances which must be closely controlled for maintaining a precise uniform flow characteristic between the tubes includes not only the size and shape of the dimples, but also the tolerances of the outer diameter of the inner tube, and the inside diameter of the outer tube. In practice, the additive effect of these variables often produces an undesirable flow variation of plus or minus between about 4% to 6%, or even greater, among tuyeres of like construction.

Flow variations in the bore of the inner tube can be held to a tolerance of plus or minus 2% for a constant tube length, which is usually considered acceptable for AOD processes, by using high quality and dimensionally accurate stock. However, such stock is relatively expensive.

A further aspect of the problem of maintaining a relatively constant and predictable gas flow rate through the tuyere is the fact that the refractory lining of the steel vessel and the discharge end of the tuyere erode during normal usage, thereby shortening the length of the annular gap and the bore of the inner tube of the tuyere. Such shortening in turn reduces the resistance to the gas flow, and the rate of flow increases as the tuyere erodes.

It is accordingly an object of the present invention to provide a tuyere of the described type which effectively overcomes the above noted limitations and disadvantages of the present designs.

It is a more particular object of the present invention to provide a tuyere which comprises concentric inner and outer tubes, and which has a calibrated and predictable gas flow restriction characteristic in the annular gap between the two tubes.

It is also an object of the present invention to provide a tuyere of the described type which provides a predictable gas flow rate through the bore of the inner tube, and while permitting the use of relatively inexpensive stock material for the inner tube.

It is another object of the present invention to provide a tuyere of the described type which provides a relatively uniform flow rate characteristic through the annular gap and the inner tube, at a given gas pressure, which flow rate is maintained as the discharge end of the tuyere and adjacent refractory lining of the vessel erode during use, to thereby provide a uniform distribution of the gases throughout the full life of the refractory lining and tuyere.

It is a further object of the present invention to provide a method of calibrating the gas flow restriction characteristics of each tuyere of a group of tuyeres which are to be used together in a common metallurgical vessel, and so that the gas flow rate through the annular gaps of the tuyeres do not vary by more than plus or minus about 2%.

SUMMARY OF THE INVENTION

These and other objects and advantages of the present invention are achieved in the embodiment illustrated herein by the provision of a tuyere which comprises an elongate metal inner tube which defines a gas inlet end and an outlet end, a first gas connection means mounted adjacent the inlet end for admitting a gas to the interior of the inner tube, an elongate metal outer tube concentrically surrounding the inner tube and so as to form an annular gap therebetween, and a second gas connection means mounted to the outer tube for admitting a second gas into the annular gap. Further, there is provided means disposed in the annular gap for maintaining the radial separation of the inner and outer tubes across the gap, and restriction means is provided for providing a closely predetermined flow rate of the second gas through the annular gap. This restriction means preferably includes a deformation of predetermined extent in the wall of one or both of the inner and outer tubes and forming a restriction in the annular gap. The restriction means is preferably in the form of an annular groove in the wall of the outer tube and which extends inwardly toward, but is spaced from, the inner tube. Also, the means for maintaining the separation of the inner and outer tubes preferably comprises a plurality of dimples formed in the wall of the outer tube, and with the dimples extending inwardly so as to engage the inner tube.

From the above, it will be seen that the present invention accepts the manufacturing tolerances and limitations which are inherent in the double tube configuration, but adds a restriction to the annular gap which serves to compensate for the manufacturing tolerances, and which can be imparted after the tuyere has been manufactured and assembled.

The present invention further provides that a restriction means also may be positioned in either the inner tube or the associated gas connection means, for providing a closely predetermined flow rate of the gas through the interior of the inner tube. In addition, the restrictions in the annular gap and the bore of the inner tube are positioned adjacent the inlet of upstream ends thereof, so that the erosion of the outlet end portions of the tubes does not appreciably effect the gas flow rates through the annular gap and the inner tube.

The present invention also provides for the calibration of the flow rate in the annular gap of the tuyere, by controlling the extent of the deformation of the annular restriction. In practice, the flow rate of a gas passing through the annular gap may be held to within a variation of not more than plus or minus about 2%, at a given gas pressure. This calibration of the tuyere may be carried out so that the tuyeres of a group selected for use with a common metallurgical vessel will have very similar gas flow characteristics. Thus for example, the gas flow rate of a test gas through the annular gap of all of the tuyeres of the group may be initially measured, and thereafter, a flow rate slightly below the minimum measured rate may be selected. The annular restriction is then formed in each of the tuyeres by deforming the wall of the outer tube inwardly so as to form a continuous annular groove therein, and the extent of the deformation is controlled so that the flow rate through the annular gap of each tuyere is within plus or minus about 2% of the selected value.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
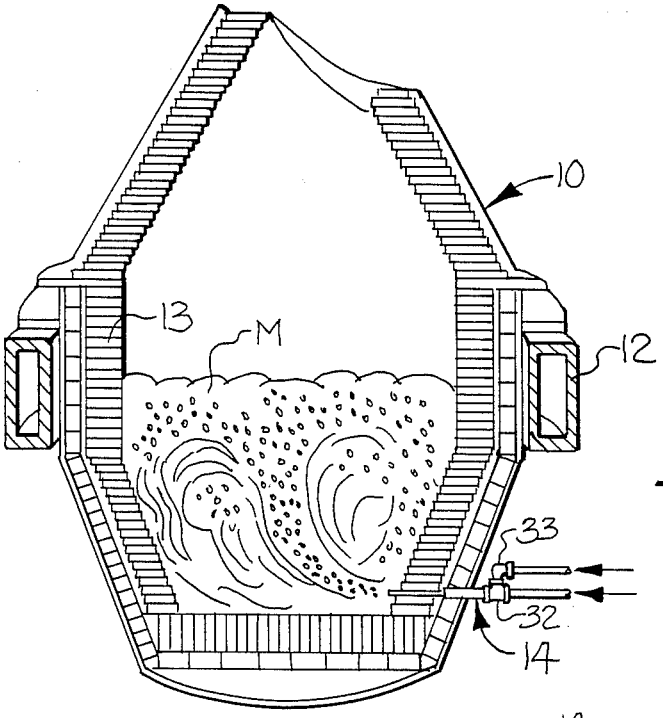
FIG. 1 is a schematic sectional view of a typical AOD metallurgical vessel, and which illustrates one tuyere mounted in the side wall and which embodies the features of the present invention.

Referring more particularly to the drawings, FIG. 1 schematically illustrates a metallurgical refining vessel 10 of the type presently used for AOD processing. Vessels of this type are conventionally employed to refine all types of steels in heat sizes up to about 175 tons, and the vessel is mounted on a tilting trunnion ring 12 to permit tilting, which facilitates charging, sampling, and tapping. Also, the vessel includes a refractory lining 13, and a number of tuyeres 14 are mounted so as to extend through the lining for injecting gases into the metal melt M.

FIGS. 2, 3, 5 and 6 illustrate a preferred embodiment of the tuyere 14 in greater detail. The tuyere 14 comprises an elongate metal inner tube 16, which defines a gas inlet end 17 and an outlet end 18. A first gas connection means is mounted adjacent the inlet end 17 of the tube, and comprises a tubular coupling 20 having a spacer ring 21 soldered in the bore thereof, and with the inlet end 17 of the tube 16 in turn being soldered in the bore of the spacer ring 21. Thus the coupling 20 is adapted to admit a gas to the interior of the inner tube 16, and so that the gas flows therethrough and discharges from the outlet end 18.

The tuyere 14 also includes an elongate metal outer tube 22 which concentrically surrounds the inner tube in a radially spaced apart relation, and so as to form an annular gap 24 therebetween. The outer tube 22 has an inlet end 26 adjacent but axially spaced from the inlet end 17 of the inner tube 16, and an outlet end 27 which is coincident with the outlet end 18 of the inner tube. The upstream portion of the axial length of the outer tube is surrounded by a metal coupling sleeve 28, and the sleeve 28 is fixedly mounted to the outer tube 22 via a spacer ring 30 which is soldered to the sleeve 22 and the outer tube. The opposite or downstream end of the sleeve 28 may also be attached to the tube 22 by conventional means. Thus the sleeve 28 provides a firm support for mounting the tuyere in the refractory lining 13 of the metallurgical vessel as seen in FIG. 1.

A second gas connection means is provided for admitting a second or shroud gas into the annular gap 24 and at a location adjacent the inlet end 26 of the tube 22, and so that the second gas flows along the gap and discharges at the outlet end 27. The second gas connection means comprises a T-shaped connection 32 which is threadedly mounted to the coupling sleeve 28, as well as the coupling 20. Also, an elbow 33 is threadedly connected to the connection 32.

The illustrated tuyere 14 also incorporates a plurality of dimples 35 formed in the wall of the outer tube 22, and with the dimples extending inwardly so as to engage the inner tube 16. The number, size, shape and locations of the dimples 35 are not critical, however, it is advantageous that they be symetrically located about the circumference of the outer tube 22, and preferably no more are formed than are necessary to support the outer tube concentrically about the inner tube and maintain the annular gap 24 uniformly along the length of the tubes. The dimples 35 in the wall of the outer tube may be formed by any number of well known manual or automatic mechanical processes.

In accordance with the present invention, a restriction is also positioned in the annular gap and at a location immediately adjacent the downstream end of the coupling sleeve 28, for providing a closely predetermined flow rate of the second gas through the annular gap. More particularly, the restriction is in the form of an annular groove 36 which is formed in the wall of the outer tube 22, and which extends inwardly toward but is spaced from the inner tube 16, note FIG. 6.

In the illustrated embodiment, a restriction is also positioned in the bore of the inner tube 16, for providing a closely predetermined flow rate of the gas through the interior of the inner tube. This second restriction is in the form of an annular inward deformation or groove 38 of predetermined extent in the wall of the inner tube, with the deformation being located adjacent but axially spaced from the inlet end 17 of the tube 16 and within the coupling sleeve 28. Also, the groove 38 is axially spaced from the annular groove 36 in the wall of the outer tube.

Figure 4:
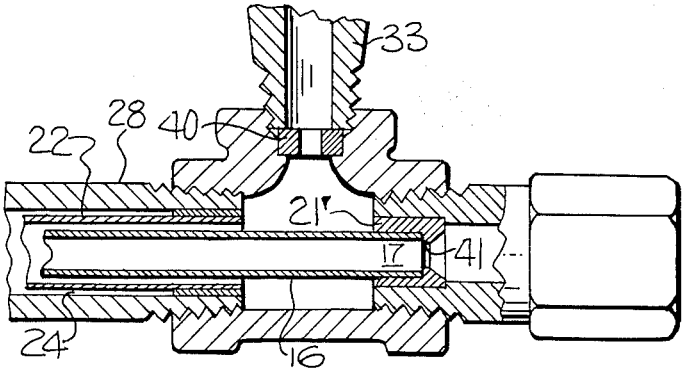
FIG. 4 is similar to FIG. 3, but illustrating a modified embodiment of the restriction for the passageway through the inner tube.
Figure 5:
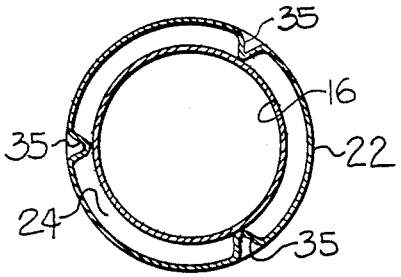
FIG. 5 is a sectional view taken substantially along the line 5—5 of FIG. 2.
Figure 6:
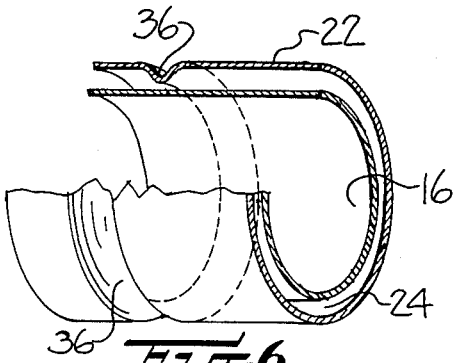
FIG. 6 is a fragmentary and sectional perspective view taken along the line 6—6 of FIG. 2.

FIG. 4 illustrates an alternative embodiment of the restriction for the gas flowing through the annular gap 24, and which takes the form of a spacer ring 40 mounted in the bore of the elbow 33. The spacer ring 40 has a reduced diameter portion of predetermined dimension which is designed to provide a closely predetermined gas flow rate through the annular gap 24 at a given pressure. FIG. 4 also illustrates an alternative embodiment of the restriction for the gas flowing through the interior of the inner tube 16, and which takes the form of a reduced diameter portion 41 on the spacer ring 21'. This reduced diameter portion is similarly designed so as to provide a closely predetermined gas flow rate through the interior of the inner tube 16.

Figure 7:
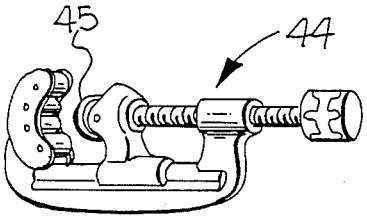
FIG. 7 is a perspective view of a tool suitable for use in forming the annular groove in the wall of the outer tube of the present invention.
Figure 8:
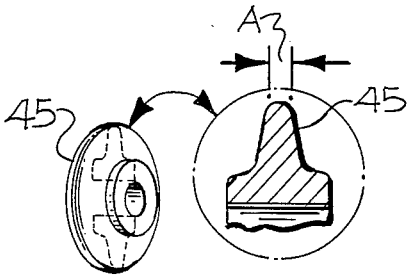
FIG. 8 is a perspective view of the deforming wheel adapted for use with the tool shown in FIG. 5, together with a fragmentary sectional view thereof.

FIGS. 7–8 illustrate a suitable tool 44 which may be used for deforming the wall of the outer tube 22 to form the annular groove 36 in the annular gap, and for deforming the wall of the inner tube 16 to form the annular groove 38. The tool 44 is generally similar to a tube cutter, but instead of a conventional cutting wheel, a blunt wheel 45 as best seen in FIG. 8 is employed. The particular cross-section of the wheel is not critical, although it should be sufficiently blunt so that it will not cut or fracture the outer or inner tube as it is rolled about the tube to form the groove 36 or 38. Preferably, wheels having a width dimension A of between about 0.032 to 0.250 inches with a gradual radius produce good results with no sign of material fatigue.

Figure 9:
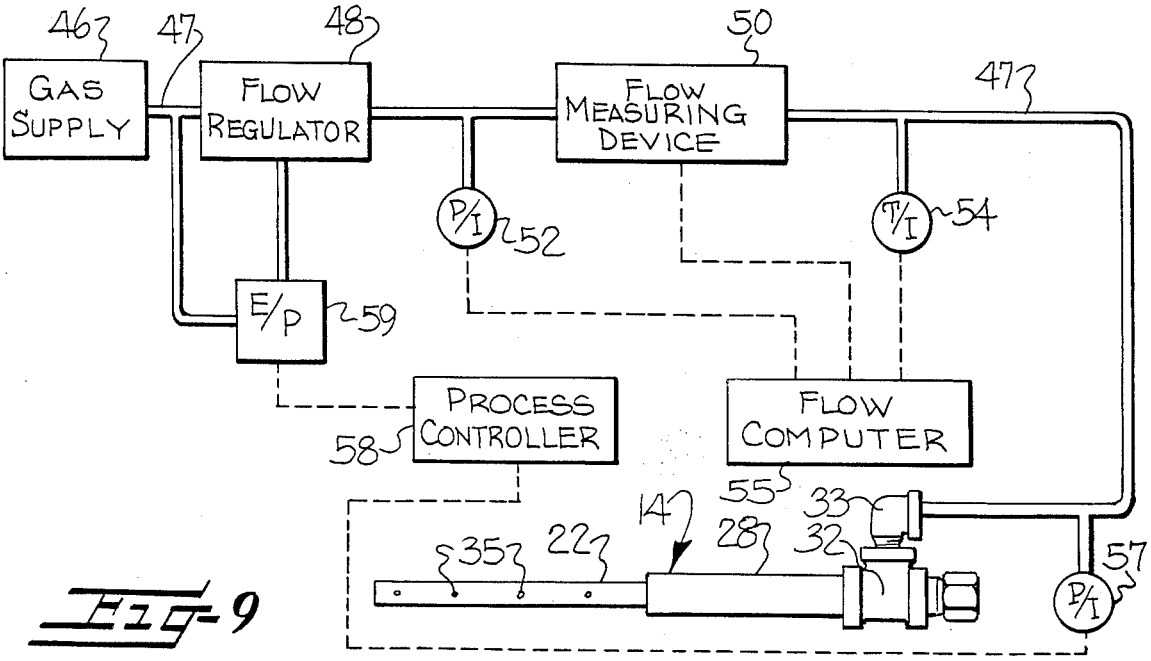
FIG. 9 is a schematic illustration of the pneumatic and electrical system for calibrating a tuyere in accordance with the present invention.

FIG. 9 schematically illustrates a system for calibrating the gas flow through the annular gap of a tuyere 14, or a group of tuyeres, in accordance with the present invention. In the illustration, the pneumatic lines are indicated in solid lines, and the electrical lines are indicated in broken lines. Also, in the illustrated embodiment, the system includes a test gas supply 46, which may comprise any suitable gas, such as nitrogen or clean dry air. The gas supply is connected to a supply line 47 which leads to a pilot operated flow regulator 48, a volumetric flow measuring device 50, and then to the elbow 33 of the tuyere 14. A pressure indicator 52, a temperature indicator 54, and a flow computer 55 are associated with the flow measuring device 50, and such that the flow computer reads the pressure and temperature, and corrects the output of the flow measuring device 50 to standard conditions in accordance with known techniques.

A pressure indicator 57 is attached to the pneumatic line 47 adjacent the elbow 33, and the indicator 57 thus monitors the gas pressure entering the annular gap 24. The output of the pressure indicator 57 is connected to a process controller 58, which is designed to adjust the regulator 48 to maintain a constant pressure at the inlet to the tuyere. The controller 58 adjusts the regulator 48 by means of an electrical signal to pneumatic converter 59, which provides a pneumatic signal to control the regulator 48 which is proportional to the electrical signal from the controller 58.

To calibrate a tuyere 14, the pressure delivered to the tuyere is adjusted so as to reach a predetermined pressure, such as about 50 psi, and this pressure is automatically maintained by the controller 58 during calibration. Next, the tool 44 is positioned on the outer tube 22 and rolled about the tube so as to form the annular groove 36. The depth of the groove is increased until the desired flow rate as indicated by the device is reached.

Where a group of tuyeres is to be calibrated, the calibration process includes initially measuring the flow rate through the annular gap of all or a representative number of the tuyeres of the group, and prior to the formation of the annular grooves 36. Thereafter, a flow rate slightly below the minimum of the measured values is selected, and the individual tuyeres are then again mounted in the testing system, and the annular groove 36 is formed in the wall of the outer tube 22 of each tuyere, with the extent of the deformation being controlled for each tuyere so that its flow rate through the annular gap is within plus or minus about 2% of the selected value at the given uniform pressure, and preferably within plus or minus 1% of the selected value.

As is well understood by those skilled in the art, the flow in the annular gap 24 and through the bore of the inner tube 16 are operated at critical flow conditions. Assuming isentropic flow of an ideal gas, sonic velocity is obtained in the tube 16 and annular gap 24 of the tuyere, but the velocity of the gas as it exits from the flow passages will be less than sonic because the tuyere itself is not an ideal nozzle. The annular flow restriction, which the present invention adds to the annular gap, should be minimal so that the velocity in the tuyere, and the total flow rate at a given operating pressure, is not reduced significantly. As a specific example, the inner tube may have an outer diameter of about 0.500 inches, the outer tube may have an inner diameter of about 0.555 inches, and the groove 36 is deformed inwardly a distance on the order of about 0.015 inches.

Figure 2:
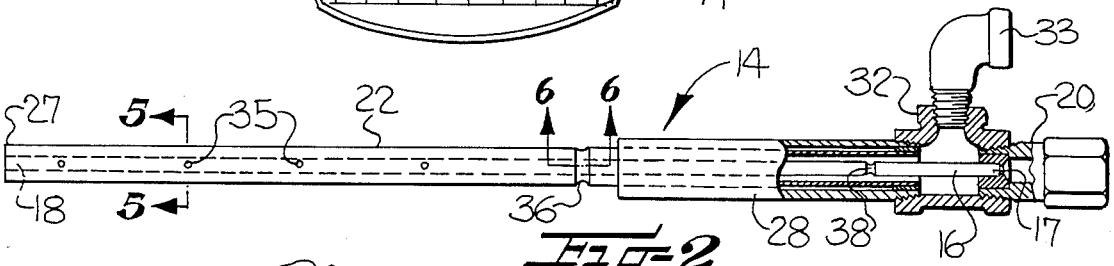
FIG. 2 is a sectional side elevation view of the tuyere shown in FIG. 1.
Figure 3:
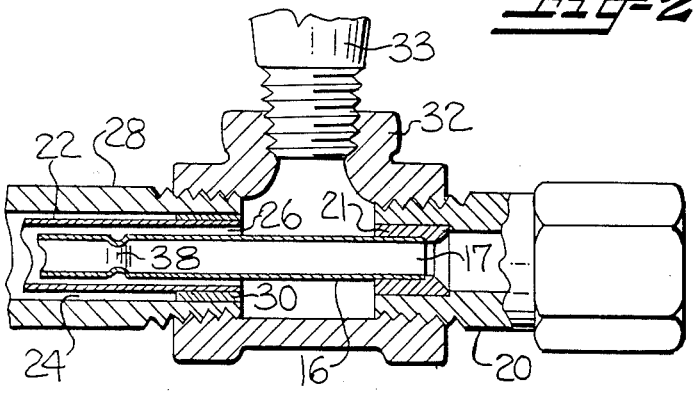
FIG. 3 is a fragmentary enlarged view of a portion of the tuyere shown in FIG. 2.

The positioning of the annular groove 36 at a location immediately adjacent the downstream end of the sleeve 28 as best seen in FIG. 2, results in the annular groove 36 being located closer to the inlet ends of the two tubes than the outlet ends thereof. Also, the annular 38 of the inner tube 16 is located immediately adjacent the inlet end thereof. This positioning of the restrictions is advantageous, in that the flow rate through the annular gap 24 and the interior of the inner tube 16 will not appreciably change as the discharge end of the tuyere and the adjacent refractory lining erode during use. Also, the erosion will not reach the restrictions during the normal life of the tuyere. Thus the uniformity of the distribution of the gases in the vessel 10 is maintained throughout the life of the refractory lining of the vessel and the life of the tuyere.

It will be evident to those skilled in the art that other methods may be used in accordance with the present invention to achieve tuyeres having predictable flow rates. For example, the procedure for introducing an annular restriction in annular passage 24 could comprise expanding the outer diameter of the inner tube 16, or deforming the walls of both of the tubs. Another procedure that can be used in accordance with the invention is to impress additional dimples 35, preferably in circumferential line with the supporting dimple, to introduce the annular restriction. The depth of the additional dimples can be controlled to precisely control the restriction.

In the drawings and specification, there has been set forth a preferred embodiment of the invention, and although specific terms are employed, they are used in a generic and descriptive sense only and not for purposes of limitation.

We claim:

1. A tuyere for the injection of gases into metallurgical vessel and which is capable of producing a predetermined gas flow rate therethrough when in use, and comprising an elongated metal inner tube which defines a gas inlet end and an outlet end, first gas connection means communicating with said inlet end for admitting a first gas to the interior of said inner tube and so that the first gas flows therethrough and discharges from said outlet end, an elongate metal outer tube concentrically surrounding said inner tube and so as to form an annular gap therebetween, second gas connection means communicating with said annular gap for admitting a second gas thereinto and so that the second gas flows along said gap and discharges at said outlet end, means disposed in said annular gap for maintaining the separation of said inner and outer tubes across said gap, and restriction means including a deformation of predetermined extent in the wall of one or both of said inner and outer tubes and forming a restriction in said annular gap for providing a predetermined flow rate of the second gas through said annular gap.

2. The tuyere as defined in claim 1 wherein said restriction is in the form of an annular groove in the wall of said outer tube and which extends inwardly toward but is spaced from said inner tube.

3. The tuyere as defined in claim 2 wherein said means for maintaining the separation of said inner and outer tubes comprises a plurality of dimples formed in the wall of said outer tube, and with said dimples extending inwardly so as to engage said inner tube.

4. The tuyere as defined in claim 2 further comprising a metal coupling sleeve concentrically surrounding a portion of the length of said inner and outer tubes adjacent said inlet end, with said coupling sleeve being fixedly mounted with respect to said inner and outer tubes and providing a firm support for mounting the tuyere into the wall of the metallurgical vessel.

5. The tuyere as defined in claim 4 wherein said annular groove is positioned immediately adjacent the downstream end of said metal coupling sleeve.

6. The tuyere as defined in claim 1 further comprising means including second restriction means positioned in either said inner tube or said first gas connection means for providing a predetermined flow rate of the first gas through the interior of said inner tube.

7. The tuyere as defined in claim 6 wherein said second restriction means comprises an annular deformation of predetermined extent in the wall of said inner tube.

8. A tuyere for the injection of gases into a metallurgical vessel and which is capable of producing a predetermined gas flow rate therethrough when in use, and comprising an elongated metal inner tube which defines a gas inlet end and an outlet end, first gas connection means communicating with said inlet end for admitting a first gas to the interior of said inner tube and so that the first gas flows therethrough and discharges from said outlet end, an elongate metal outer tube concentrically surrounding said inner tube and so as to form an annular gap therebetween, and with said annular gap defining a gas inlet end adjacent said inlet end of said inner tube and a gas outlet end adjacent said outlet end of said inner tube, second gas connection means communicating with said inlet end of said annular gap for admitting a second gas into said annular gap and so that the second gas flows along said gap and discharges at said outlet end of said annular gap, means disposed in said annular gap for maintaining the separation of said inner and outer tubes across said gap, first restriction means positioned in either said annular gap or said second gas connection means for providing a predetermined gas flow rate of the second gas through said annular gap, and second restriction means positioned in either said inner tube or said first gas connection means for providing a predetermined flow rate of the first gas through the interior of said inner tube.

9. The tuyere as defined in claim 8 wherein said first restriction means comprises an annular groove in the wall of said outer tube and which extends inwardly toward but is spaced from said inner tube, and said second restriction means comprises an annular groove in the wall of said inner tube which extends inwardly into the interior thereof.

10. The tuyere as defined in claim 9 wherein said annular grooves of said first and second restriction means are each positioned at a location closer to the respective inlet end than the respective outlet end, and such that erosion of the outer end portions of said inner and outer tubes does not normally reach the annular grooves and does not appreciably effect the gas flow rates through said inner tube and said annular gap.

11. A method of calibrating the air flow characteristics of a tuyere for the injection of gases into a metallurgical vessel, and comprising the steps of providing a tuyere which comprises inner and outer concentric metal tubes, with the tubes being radially separated to form an annular gap therebetween, and with the annular gap defining an inlet end and an outlet end, deforming the wall of one of said inner and outer tubes into said annular gap and so as to form an annular restriction in said annular gap, and with the extent of the deformation being controlled so as to provide a predetermined flow rate of a gas passing through said annular gap.

12. The method as defined in claim 11 wherein the deforming step is conducted at a location closer to said inlet end of said annular gap than said outlet end thereof.

13. The method as defined in claim 12 wherein the deforming step includes inwardly deforming the wall of said outer tube to form a continuous annular groove therein.

14. A method of calibrating the gas flow characteristics of a group of tuyeres for the injection of gases into a metallurgical vessel, and so that all of the tuyeres of the group have similar gas flow rates, and comprising the steps of providing a group of tuyeres, with each tuyere of the group comprising inner and outer concentric tubes, and with the tubes being radially separated to form an annular gap therebetween, and calibrating each of the tuyeres by inwardly deforming the wall of the outer tube of each of said tuyeres so as to form a continuous annular groove therein, and with the extend of the deformation of each tuyere being controlled so that all of said tuyeres have essentially the same flow rates for a gas flowing through said annular gap.

15. The method as defined in claim 14 wherein the calibration step for each tuyere includes the further steps of passing a test gas through said annular gap, while maintaining the pressure of the gas at a predetermined level, and while monitoring the gas flow rate through the annular gap, and wherein the extent of said deformation is controlled in response to the monitored gas flow rate.

16. The method as defined in claim 15 wherein the extent of the deformation of each tuyere is controlled so that the monitored flow rate of the test gas passing through the annular gap does not vary by more than plus or minus about 2% among the tuyeres.

17. The method as defined in claim 16 comprising the further steps of initially measuring the flow rate of a test gas through the annular gap of a plurality of the tuyeres of said group, then selecting a flow rate slightly below the minimum of the measured rates, and wherein the deforming step is conducted subsequent to the measuring and selecting steps and includes controlling the deformation of each tuyere so that the flow rate of the test gas through the annular gap is within plus or minus about 2% of the selected value.

* * * * *

UNITED STATES PATENT AND TRADEMARK OFFICE

CERTIFICATE OF CORRECTION

PATENT NO. : 4,795,138

DATED : January 3, 1989

INVENTOR(S) : Ronald Elmer Fuhrhop and Allan Roy Wandelt

It is certified that error appears in the above-identified patent and that said Letters Patent is hereby corrected as shown below:

Column 7, line 7, "tubs" should be -- tubes --.

Column 9, line 21, "extend" should be -- extent --.

Signed and Sealed this

Thirtieth Day of May, 1989

*Attest:*

*Attesting Officer*

DONALD J. QUIGG

*Commissioner of Patents and Trademarks*